United States Patent [19]

Kaczynski et al.

[11] Patent Number: 4,834,043

[45] Date of Patent: May 30, 1989

[54] FUEL INJECTION NOZZLE FOR INTERNAL COMBUSTION ENGINES

[75] Inventors: Bernhard Kaczynski, Waiblingen; Alfred Schmitt, Ditzingen, both of Fed. Rep. of Germany

[73] Assignee: Robert Bosch GmbH, Stuttgart, Fed. Rep. of Germany

[21] Appl. No.: 156,863

[22] PCT Filed: Jan. 15, 1987

[86] PCT No.: PCT/DE87/00015

§ 371 Date: Jan. 7, 1988

§ 102(e) Date: Jan. 7, 1988

[87] PCT Pub. No.: WO87/07335

PCT Pub. Date: Dec. 3, 1987

[30] Foreign Application Priority Data

May 23, 1986 [DE] Fed. Rep. of Germany ..... 3617353

[51] Int. Cl.[4] ..... F02M 31/12

[52] U.S. Cl. ..... 123/297; 123/298; 123/549; 239/133

[58] Field of Search ..... 123/297, 298, 549, 145 A; 239/133

[56] References Cited

U.S. PATENT DOCUMENTS 1,641,421 9/1927 French .

2,130,365 9/1938 Paulson ..... 123/145 A 4,572,146 2/1986 Grünwald et al. ..... 123/298

FOREIGN PATENT DOCUMENTS 0140148 5/1985 European Pat. Off. .

3404708 8/1985 Fed. Rep. of Germany .

84/04567 11/1984 PCT Int'l Appl. .

233939 12/1944 Switzerland .

964715 7/1964 United Kingdom .

2153909 8/1985 United Kingdom .

*Primary Examiner*—Andrew M. Dolinar

*Attorney, Agent, or Firm*—Michael J. Striker

[57] ABSTRACT

A fuel injection nozzle for internal combustion engines includes a glow element connected to the outlet side of the injection port, the glow element being integrated into the clamping nut which braces the nozzle body with the nozzle holder. Downstream of the nozzle body, the clamping nut has a support shoulder, on which a sleeve surrounding and carrying the glow element rests. The glow element is formed by a jacket heating conductor, shaped into a dimensionally stable coil which is electrically connected with the contact element and with the sleeve. The connection end of the jacket heating conductor may be formed as a so-called cold end, as a result of which the adjoining parts are thermally relieved.

10 Claims, 2 Drawing Sheets

FUEL INJECTION NOZZLE FOR INTERNAL COMBUSTION ENGINES

BACKGROUND OF THE INVENTION

The invention relates to a fuel injection nozzle. Injection nozzles of the kind under discussion can be assembled easily, because the glow element together with the sleeve and the contact element, as a pre-fabricated structural unit, can be inserted into the clamping nut from its open end and pushed as far as the support shoulder. In the known injection nozzles of this generic type (German Patent Application 35 02 109.8), the glow element is embodied by a wire coil, which is supported and electrically contacted on the sleeve on its end remote from the contact element. This embodiment dictates a sleeve having internal protrusions, which make manufacture more difficult and also hinder the flow of the air aspirated by injector action.

SUMMARY OF THE INVENTION

It is an object of the present invention to provide a fuel injection nozzle which has the advantage over the prior art that the aspirated air can flow substantially unhindered from the combustion chamber into the annular space formed between the sleeve and the glow element, and that the sleeve does not have to have any internal protrusions. The jacket heating conductor provided for forming the glow element is a time-tested structural element which is capable of producing high electrical heating outputs.

Assembling the glow attachment comprising the glow element, sleeve and contact element is simplified still further if the outer annular jacket of the jacket heating conductor is electrically contacted with the end remote from the contact element of the inner resistance wire and is soldered to the sleeve at at least one point.

The sharp bending of the end portion of the jacket heating conductor connected to the contact element toward the associated end region of the coil is avoided if this end region is disposed at the side of the combustion chamber and the coil extends counter to the flow direction of the fuel toward the nozzle body.

It is particularly advantageous if the end portion oriented toward the contact element of the jacket heating conductor is embodied as a so-called cold end, which presents a lesser electrical resistance to the heating current than the remaining portion of the jacket heating conductor.

As a result, the sleeve, the connection end of the jacket heating conductor and in particular the sealing provided there, and the contact element are subject to less thermal stress than when a jacket heating conductor lacking a cold end is used.

One possible way to attain a cold end of the jacket heating conductor is to use in that region of the jacket heating conductor, a material, such as copper, that has a lesser electrical resistance than that in the remaining region, and to provide the shortest possible transition zone, that is, the junction between the copper and the heating conductor.

Another preferred possibility is to produce dissimilar cross-sectional faces of the annular jacket and of the inner resistance wire, in particular by hammering or drawing the corresponding part of the jacket heating conductor prior to the winding. In the final analysis, this results in a thickened end portion as compared with an embodiment lacking a cold end, the greater surface area of which is likewise effective in providing a thermal relief of the jacket heating conductor sealing and of the contact element.

If a sleeve disposed between the nozzle body and the clamping nut is provided for conducting current, the contact element, given the above-described provisions for reducing the thermal load, can also be formed directly by a thickened or inwardly extended rim of the sleeve.

The assembly of the injection nozzle is simplified if the jacket heating conductor, the sleeve that carries and electrically contacts it, a ceramic insulting body resting on its upper face end and the contact element are prefabricated into an insertion unit by soldering or gluing.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
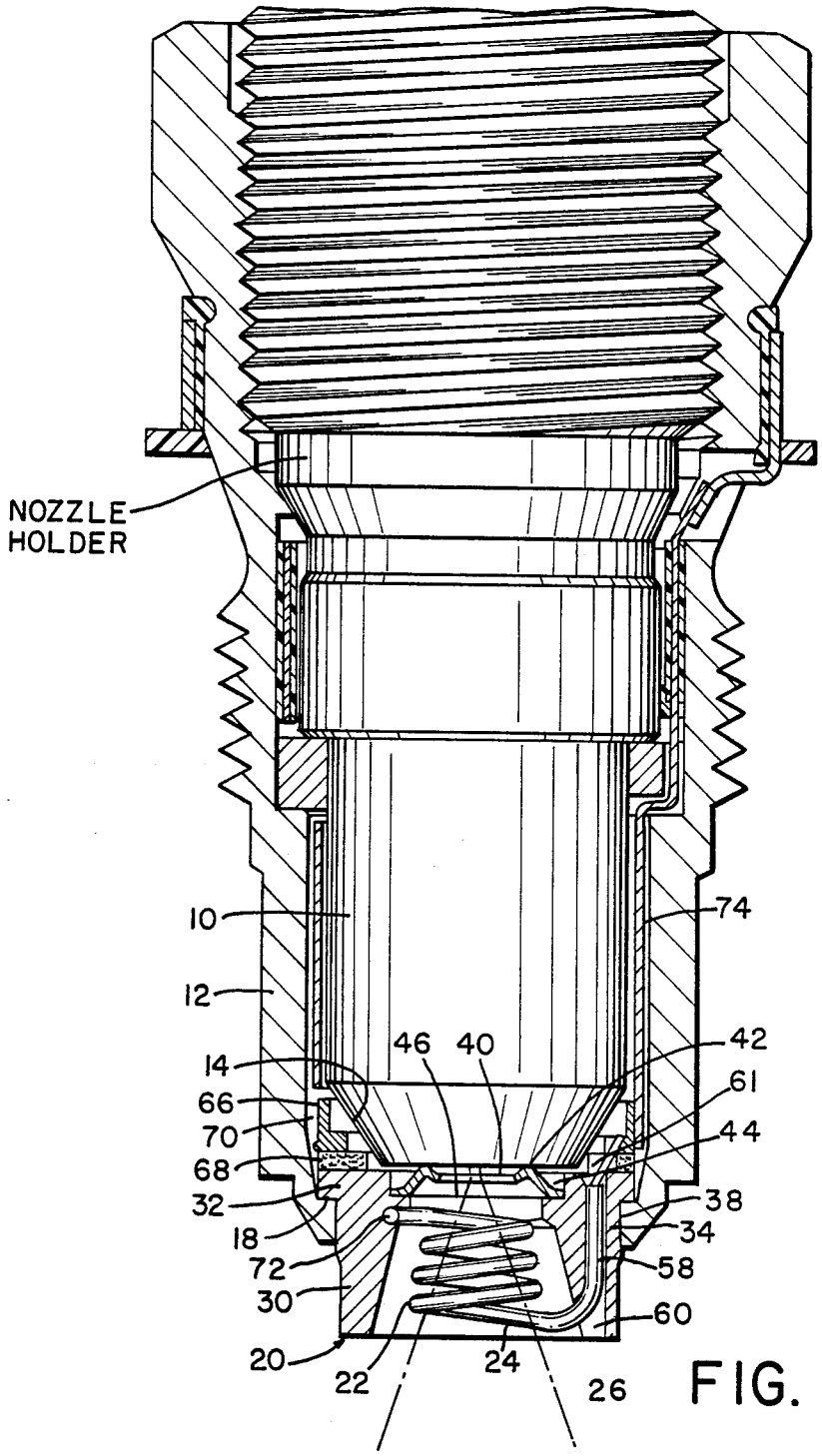
FIG. 1 shows a sectional view of the portion of the injection nozzle the first embodiment, on an enlarged scale.
Figure 2:
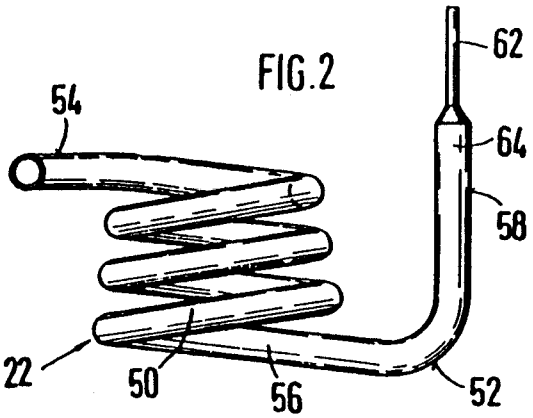
FIG. 2 shows a perspective view of the glow element of the injection nozzle.

The injection nozzle shown in FIGS. 1 and 2 has a nozzle body 10, in which in a known non shown manner a valve seat is formed and a valve needle is displaceably supported. The nozzle body 10 and an intermediate washer that limits the stroke of the valve needle are fastened by means of a clamping nut 12 to a nozzle holder, in which among other elements, a closing spring that presses the valve needle against the valve seat is accommodated. On the end which faces the combustion chamber, the nozzle body 10 is provided into a conical wall section 14, which merges with a flat end wall 16.

The clamping nut 12 is extended beyond the nozzle holder 10 toward the combustion chamber, and downstream from its end wall 16 is provided with an inner support shoulder 18, on which a glow insert identified overall by reference numeral 20 rests. This glow insert has as a central structural component a glow element 22 formed as a helix, and which forms a passageway 24 for the injection streams 26. The glow element 22 is dimensioned such that the injection streams do not moisten the glow element, but instead produce an injector action, by means of which air is aspirated out of the combustion chamber into the interior of the glow element 22.

The glow element 22 is surrounded by a metal sleeve 30, which has a cylindrical section 32 of a larger diameter and a cylindrical section 34 of a smaller diameter. At the transition between the sections 32 and 34, an annular shoulder 36 is formed, which rests on the support shoulder 18 of the clamping nut 12. Downstream of the support shoulder 18, the clamping nut 12 is provided with a bore portion 38, which surrounds the section 34 of the sleeve 30 in a fitting and sealing manner.

Between the sleeve 30 and nozzle body 10, a metal thermal insulation ring 40 is fastened in a deformed fashion, pressing sealingly with an inner annular rim 42 against the end wall 16 of the nozzle body 10. The outer annular rim 44 of the thermal insulation ring 40, which is axially offset from the inner annular rim 42 formed, is sealingly supported on an annular shoulder 46 in the interior of the sleeve 30 and presses the sleeve in a vibration-proof manner against the support shoulder 18 when the clamping nut 12 has been screwed on. The thermal insulation ring 40 protects the end wall 16 of the nozzle body 10 from the thermal radiation of the glow element 22 and dissipates heat from the end wall 16 to the sleeve 30, from whence it can be removed via the clamping nut 12 to the engine housing.

The glow element 22 in accordance with the invention is formed by a jacket heating conductor of a known type, the middle region of which is wound into a coil 50 (FIG. 2). The coil 50 is provided with two stretched connection ends 52, 54, both of which originate at a tangent to the winding diameter. The connection end 52 of the coil 50 is associated with the end section 56 which faces the combustion chamber and is provided with a bent-over section 58, which is extended through a bore 60 extending parallel to the nozzle axis and the sleeve 30 and is soldered into place in a sealing manner therein. The resistance wire and jacket are sealed in a high-temperature-proof manner after the insertion of the section 58 and the soldering in the bore 60. At the end of the section 58, the inner resistance wire 62 of the jacket heating conductor 22 is extended a predetermined distance out of the outer annular jacket 64.

The end of the inner resistance wire 62 extended out of the outer annular jacket 64 is soldered to a contact ring 66, which is secured, with the interposition of a ceramic insulating ring 68, to the upper face end of the sleeve 30. The fastening can be effected by gluing or soldering. The insulating ring 68 and the contact ring 66 are disposed in the wedge-shaped annular space 70 formed between the conical wall section 14 of the nozzle body 10 and the clamping nut 12. The contact ring 66 is connected to a current supply sleeve 74, the structure of which is not of further importance here and is described, for instance in German Patent Application 34 02 098.

The coil 50 extends from its entry-side end region 56 counter to the flow direction of the fuel toward the nozzle body 10, the winding diameter of the coil becoming continuously smaller. The second connection end 54 of the coil 50 is supported in a wall notch 72 in the interior of the sleeve 30. The outer annular jacket 64 of the jacket heating conductor 22 is electrically connected at the connection end 54 with the inner resistance wire 62 and itself serves as a ground conductor, connecting the end of the resistance wire 62 remote from the contact ring 66 with the sleeve 30 and via it with ground. To this end, the outer annular jacket 64 is soldered to the sleeve 30 at both ends.

In the embodiment described, the jacket heating conductor 22 can be formed without cold ends, in a cost-saving manner, to prevent a severe overheating of the contact ring 66.

Assembling of the injection nozzle is done such that first the sleeve 30, with the glow element 22, the insulating ring 68 and the contact ring 66, is pre-fabricated into a structural unit.

After that, the current supply sleeve 74 is electrically connected with the contact ring 66. This assembly is then inserted from above, with the thermal insulation ring 40 slipped onto it, into the clamping nut 12 and pushed in so far that the sleeve 30 strikes the support shoulder 18 of the clamping nut 12. When the clamping nut 12 is tightened and the nozzle body 10 is clamped against the nozzle holder, the thermal insulation ring 40 is braced as well, as a result of which the entire glow assembly is firmly retained without a play on the nozzle body 10. The sleeve 30 can also, however, be firmly connected by soldering to the clamping nut 12, or press-fit into it.

Figure 3:
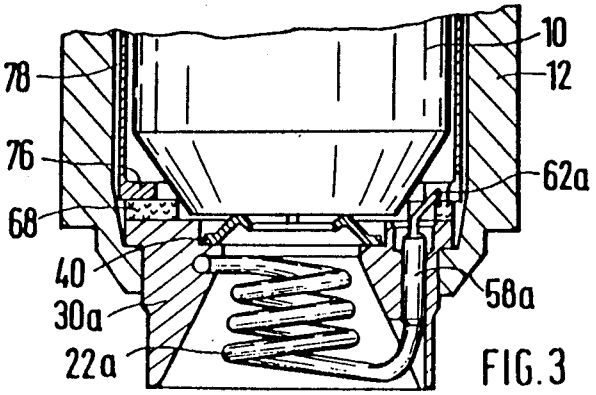
FIG. 3 shows a sectional view of the portion of the injection nozzle of the second embodiment.

The injection nozzle of FIG. 3 matches the version shown in FIGS. 1 and 2, except for two differences. One difference is that in the section **58*a* of the glow element 22*a* formed as a jacket heating conductor, both the outer annular jacket and the inner resistance wire 62*a* have a larger cross-sectional area than that of the remaining portion of the jacket heating conductor, and therefore the section 58*a* forming a so-called cold end is heated to a less severe extend by the heating current than the bent over section 58 of FIGS. 1 and 2. The second difference between the embodiments of FIGS. 1 and 3 is that a contact ring 66 (see FIG. 1) is omitted entirely, and that the inner resistance wire 62*a* of the jacket heating conductor 22*a* is soldered directly to an inwardly extending rim 76 of a current supply sleeve 78, which otherwise may be formed like the current supply sleeve 74 of FIG. 1. The omission of a specific contact ring 66 is possible due to the low thermal load which results from the formation of the section 58*a* of the jacket heating conductor 22*a*** as the cold end.

Also in the embodiment of FIG. 3, the sleeve **30*a*, the flow element 22*a*, the insulating ring 68, which is suitably of ceramic, and the current supply sleeve 78** can be pre-fabricated into a structural unit by soldering.

It will be understood that each of the elements described above, or two or more together, may also find a useful application in other types of fuel injection nozzles for internal combustion engines differing from the types described above.

While the invention has been illustrated and described as embodied in a fuel injection nozzle for internal combustion engines, it is not intended to be limited to the details shown, since various modifications and structural changes may be made without departing in any way from the spirit of the present invention.

Without further analysis, the foregoing will so fully reveal the gist of the present invention tht others can, by applying current knowledge, readily adapt it for various applications without omitting features that, from the standpoint of prior art, fairly constitute essential characteristics of the generic or specific aspects of this invention.

We claim:

1. A fuel injection nozzle for an internal combustion engine, comprising a nozzle body firmly clamped by a clamping nut to a nozzle holder; a sleeve clamped by said nut; a glow element disposed downstream of the nozzle body, said glow element having a passageway for injection streams and being surrounded with a radial play by said sleeve, said nut having a support shoulder disposed downstream of said nozzle body, said sleeve resting on said support shoulder, the nozzle further having a ventilation opening leading from a side thereof into a course of the injection streams, the injection streams aspirating air through said opening from a combustion chamber of the internal combustion engine into peripheral zones of the injection streams; and a contact element connecting one current connection of the glow element with a supply line, said contact element being firmly retained together with said sleeve in the clamping nut, said contact element and said sleeve being dimensioned so that said sleeve and said contact element together with the glow element are insertable into the clamping nut from an open end thereof and pushed in to said support shoulder, said glow element (22) being formed by a jacket heating conductor shaped into a stable coil, which has an inner conductor electrically connected to said contact element (66, 76) and an outer conductor electrically connected to said sleeve (30) forming a ground conductor.

2. An injection nozzle as defined by claim 1, said jacket heating conductor (22) including an inner resistance wire and an outer annular jacket which is electrically connected with an end of the inner resistance wire (62) remote from said contact element and is soldered to said sleeve (30) at at least one point.

3. An injection nozzle as defined by claim 2, wherein the outer annular jacket (64) of the jacket heating conductor (22) is soldered at both of ends thereof to the sleeve (30).

4. An injection nozzle as defined by claim 3, wherein said coil has a bottom region (56) disposed on a side of said coil, which faces the combustion chamber, and said coil (50) extends counter to a flow direction of the fuel toward the nozzle body (10).

5. An injection nozzle as defined by claim 4, wherein said coil includes an end section (58) extended toward the contact element (66, 76) and passing through a bore (60) formed in the sleeve (30), said bore extending at least approximately parallel to an axis of the nozzle and having a mouth (61) opening toward the contact element (66, 76), said mouth being sealed in a high-temperature-proof manner after an insertion of the end section (58) into said bore.

6. An injection nozzle as defined by claim 5, wherein the end section (**58*a*) of said coil extended toward the contact element (76) is formed as a cold end, which presents a lesser electrical heating resistance to the heating current than a remaining portion of said coil (22*a***).

7. An injection nozzle as defined by claim 6, wherein the annular jacket and the inner resistance wire (**62*a*), in the vicinity of said end section (58*a*) have a larger cross-sectional area than in the remaining portion of said coil (22*a***).

8. An injection nozzle as defined by claim 7, wherein dissimilar cross-sectional areas of the annular jacket and inner resistance wire (**62*a***) are provided which are produced by hammering or drawing of a corresponding portion of said coil prior to winding thereof.

9. An injection nozzle as defined by claim 6, wherein the contact element (76) is formed by a thickened inwardly extended rim of a current supply sleeve (78) disposed between the nozzle body (10) and the clamping nut (12).

10. An injection nozzle as defined by claim 1, further including a ceramic insulating body which rests on an upper face of said sleeve, said jacket heating conductor (**22, 22*a*), said sleeve (30, 30*a*) said ceramic insulating body (68) and the contact element (66, 74, 76, 78**) being pre-fabricated into an insertion unit by soldering or gluing.

* * * * *